US009133690B1

(12) United States Patent
Tanju et al.

(10) Patent No.: US 9,133,690 B1
(45) Date of Patent: Sep. 15, 2015

(54) SYSTEM AND METHOD FOR MITIGATING PRESSURE DROP AT SUBSEA PUMP STARTUP

(71) Applicants: Baha Tulu Tanju, Houston, TX (US); Joseph Micheal Smoorenburg, Covington, LA (US); Brian Jake Arias, Houston, TX (US); Emile Boudreaux, Ingleside, TX (US); Karry Guidry, Krotz Springs, LA (US); Marcus Paul Abshire, Abbeville, LA (US); Fred Anderson, Houston, TX (US); Lee Eric Mitchell, Katy, TX (US)

(72) Inventors: Baha Tulu Tanju, Houston, TX (US); Joseph Micheal Smoorenburg, Covington, LA (US); Brian Jake Arias, Houston, TX (US); Emile Boudreaux, Ingleside, TX (US); Karry Guidry, Krotz Springs, LA (US); Marcus Paul Abshire, Abbeville, LA (US); Fred Anderson, Houston, TX (US); Lee Eric Mitchell, Katy, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 14/480,849

(22) Filed: Sep. 9, 2014

(51) Int. Cl.

| | |
|---|---|
| ***E21B 43/01*** | (2006.01) |
| ***E21B 43/12*** | (2006.01) |
| ***E21B 34/16*** | (2006.01) |
| ***E21B 34/06*** | (2006.01) |
| ***E21B 34/10*** | (2006.01) |

(52) U.S. Cl.
CPC ..... *E21B 34/16* (2013.01); *E21B 34/066* (2013.01); *E21B 34/10* (2013.01); *E21B 43/01* (2013.01); *E21B 43/12* (2013.01)

(58) Field of Classification Search
CPC ..... E21B 43/01; E21B 43/12
USPC ..... 166/344, 368, 369, 91.1; 417/26, 279
See application file for complete search history.

(56) References Cited

U.S. PATENT DOCUMENTS

| | | | | |
|---|---|---|---|---|
| 6,007,306 | A * | 12/1999 | Vilagines | 417/307 |
| 7,569,097 | B2 * | 8/2009 | Campen et al. | 95/243 |
| 8,327,942 | B2 * | 12/2012 | Grimseth et al. | 166/368 |
| 2011/0139460 | A1 * | 6/2011 | Selstad | 166/344 |
| 2011/0155385 | A1 * | 6/2011 | Haheim | 166/357 |
| 2012/0103621 | A1 * | 5/2012 | Kanstad et al. | 166/344 |
| 2012/0138307 | A1 * | 6/2012 | Berg | 166/349 |

FOREIGN PATENT DOCUMENTS

GB 2503927 A * 1/2014

OTHER PUBLICATIONS

Kondapi P. and Davalath, J. "Recirculation Loop Analysis for a Subsea Boosting System." (2012): pp. 1-12.

* cited by examiner

*Primary Examiner* — Matthew Buck
(74) *Attorney, Agent, or Firm* — Karen R. DiDomenicis

(57) ABSTRACT

Disclosed are fluid handling systems and methods for mitigating the effects of pressure drops that occur at the startup of subsea pumps associated with liquid producing reservoirs. The systems and methods are particularly useful in conjunction with subsea pumps used for producing liquids from high-pressure, low permeability hydrocarbon reservoirs. The systems and methods can mitigate damage to reservoir completions and reservoirs caused by high pressure transients downstream of the pump. A choke valve is used to restrict the flow of the liquids prior to the startup of the subsea pump. After the start of the subsea pump, the choke valve is gradually opened while a recirculation valve is gradually closed, and a full bore valve is opened.

5 Claims, 3 Drawing Sheets

SYSTEM AND METHOD FOR MITIGATING PRESSURE DROP AT SUBSEA PUMP STARTUP

FIELD

The present disclosure relates to systems and methods including subsea pumps for pumping oil and gas from offshore hydrocarbon reservoirs. The present disclosure more particularly relates to systems and methods for mitigating the effects of pressure drop that occurs at the startup of such subsea pumps.

BACKGROUND

Liquid producing reservoirs can be susceptible to reservoir damage occurring upon the startup of pumps that pump oil and gas from the reservoirs. This is a particular concern for high-pressure, low permeability hydrocarbon reservoirs. The startup of the pump introduces a sudden pressure drop that can impact all associated wells upstream of the pump. The risk of reservoir damage can be especially great for older reservoirs whose reservoir pressure has significantly dropped over time.

Depending on the long-distance power delivery system and the subsea pump design, the subsea pump can introduce a sudden pressure drop on the suction side at pump startup. As is known, the power loss in a subsea umbilical is higher at lower frequencies. The power not delivered to equipment such as the subsea pump dissipates in the umbilical as heat. In order to control the umbilical temperature, the subsea umbilical temperature design criteria specify that the subsea pump has a minimum supply frequency of 25 Hz. This corresponds to a minimum subsea pump speed of 1500 RPM. When the pump is started up, it therefore begins running at 1500 RPM thus creating a low pressure transient upstream of the pump and a high pressure transient downstream of the pump.

Over time, the cumulative effects of such pressure drops can damage the reservoir or completion.

It would be desirable to have a method to avoid deleterious effects on hydrocarbon reservoirs caused by pressure drops occurring at the start of subsea pumps.

SUMMARY

In one aspect, a method is provided for starting a subsea pump along an oil and gas flow line over a startup period of time while avoiding large pressure drops. The method includes providing a subsea pump along a flow line in which fluid is flowing and a choke valve capable of being partially closed downstream of the subsea pump. The choke valve is partially closed to restrict fluid flow through the choke valve. The subsea pump is then started so that fluid flows through the subsea pump at a subsea pump flow rate and fluid flows through the choke valve downstream of the subsea pump at a choke valve flow rate less than the subsea pump flow rate. Fluid flowing in the flow line downstream of the subsea pump is allowed to be directed through a recirculation loop, wherein the recirculation loop comprises a recirculation pipeline and the recirculation loop intersects the flow line at a first location downstream of the subsea pump and upstream of the choke valve and a second location upstream of the subsea pump and the recirculation loop further comprises a recirculation valve having a recirculation valve percentage opening along the recirculation loop. Over the startup period of time, the choke valve percentage opening is increased while the recirculation valve percentage opening is decreased. Finally, a full bore valve in a bypass loop is open. The bypass loop includes a bypass pipeline, wherein the bypass loop intersects the flow line at a location upstream or coincident with the first location at which the recirculation loop intersects the flow line and a second location downstream of the choke valve, such that fluid is directed to flow through the bypass loop.

In another aspect, a fluid handling system is provided, the fluid handling system including a flow line for transporting fluid from a reservoir to a production facility; a subsea pump along the flow line; a choke valve along the flow line and downstream of the subsea pump; a recirculation loop comprising a recirculation pipeline intersecting the flow line at a first location downstream of the subsea pump and upstream of the choke valve and a second location upstream of the subsea pump; a recirculation valve along the recirculation loop; a bypass loop comprising a bypass pipeline intersecting the flow line at a location upstream or coincident with the first location at which the recirculation loop intersects the flow line and a second location downstream of the choke valve; and a full bore valve along the bypass loop.

DESCRIPTION OF THE DRAWINGS

These and other objects, features and advantages of the present invention will become better understood with reference to the following description, appended claims and accompanying drawings where:

DETAILED DESCRIPTION

Figure 1:
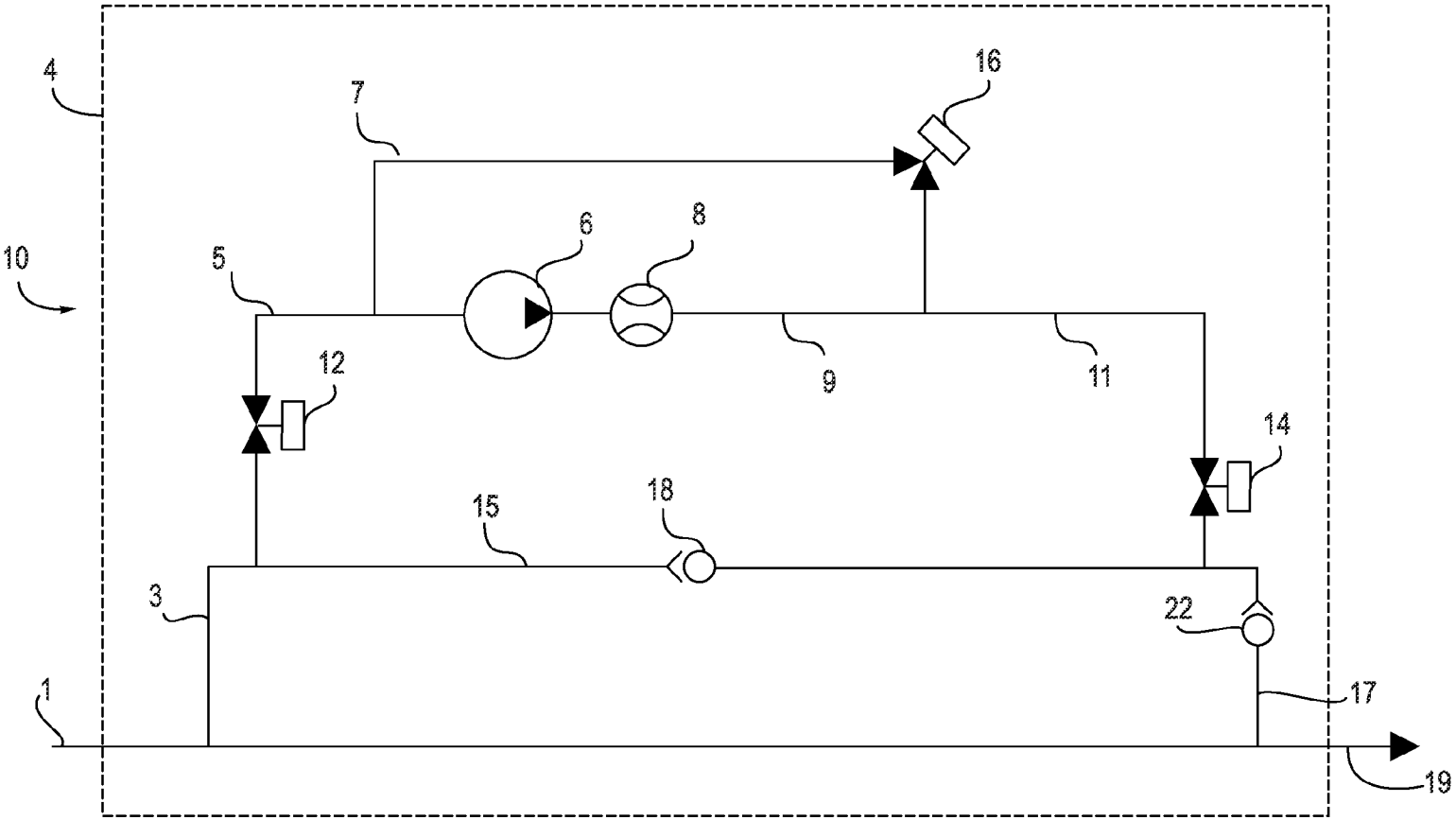
FIG. 1 (Prior Art)
FIG. 1 is a simplified diagram illustrating a fluid handling system according to the prior art.

Systems and methods will now be described for mitigating the effects of pressure drops that occur at the startup of subsea pumps associated with liquid producing hydrocarbon reservoirs. With reference to FIG. 1, a prior art fluid handling system 10 is illustrated which includes a subsea pump station 4. The subsea pump station can be located at any convenient location, e.g., on a tie-in skid (not shown). Produced fluids which can include liquid hydrocarbons, water and gas are transported through an upstream portion of a flow line 1. Provided at the pump station are isolation valves 12 and 14 which can be closed to isolate the subsea pump 6. Prior to the start up of the subsea pump 6, also referred to as the pump 6, the isolation valves 12 and 14 can be closed and produced fluids can circulate from flow line 1 through conduit 3, conduit 15, conduit 17 and into flow line 19. The portion of the flow line downstream of the pump station 4, and specifically downstream of the intersection of flow line 1 and conduit 17, is indicated by reference numeral 19. Also provided in the fluid handling system 10 can be check valves 22 and 18 to prevent back flow of fluids in conduits 17 and 15, respectively. Upon opening the isolation valves 12 and 14, a conduit 5 transports the fluids from the conduit 3 to the subsea pump 6. A flow meter 8 can also be provided in the conduit 9. The produced fluids flow from the pump 6 through the conduit in line with the pump 6, yet downstream of the recirculation loop, indicated by reference numeral 11, through conduit 17 and into flow line 19. At a point downstream of the pump 6, a recirculation loop is provided that includes a conduit 7 and a recirculation valve 16. Immediately after the start up of the subsea pump 6, a pressure transient, also referred to as a pressure drop, of 500 psi or more can be generated in a matter of a few seconds. Such a high pressure drop can result in damage to the microstructures in the reservoir itself, the reservoir completion or the pump 6.

Figure 2:
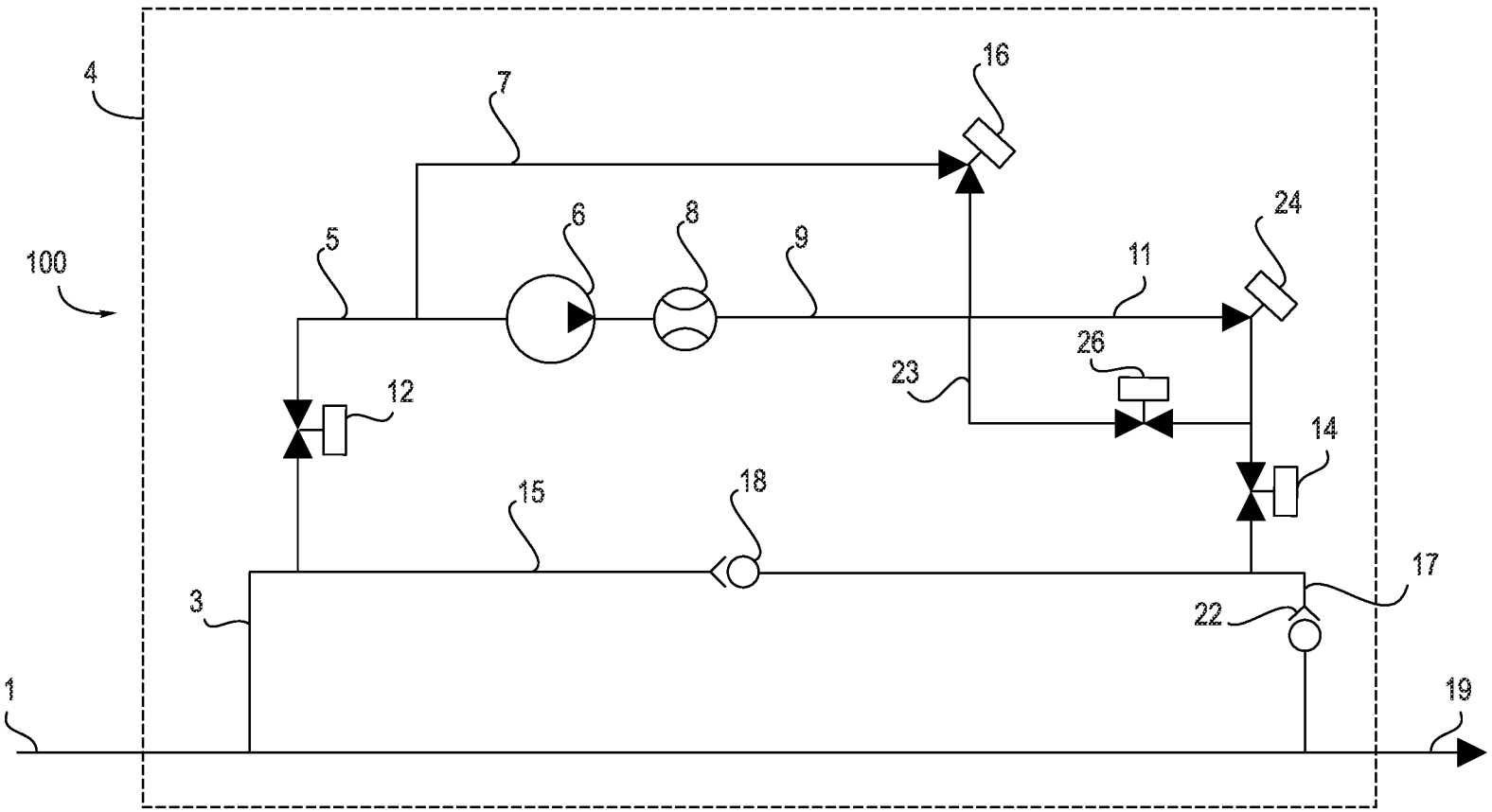
FIG. 2 is a simplified diagram illustrating a fluid handling system according to one exemplary embodiment.

With reference to FIG. 2, a fluid handling system 100 according to one embodiment is illustrated which, like the fluid handling system 10 shown in FIG. 1, also includes a subsea pump station 4. Like numerals refer to like elements throughout the disclosure. A diverter choke valve 24, also referred to as choke valve 24, is added to the conduit 11 downstream of the subsea pump 6 and downstream of the recirculation loop to partially divert produced fluids flowing through conduit 9 to the recirculation loop. Thus, during startup of subsea pump 6, the recirculation valve 16 can be opened, e.g., more than halfway, and the diverter choke valve 24 can be opened significantly less, e.g., less than halfway. In one example, the recirculation valve 16 can be 75% open and the diverter choke valve 24 can be 25% open during startup of the pump. An inverse relationship should exist between the percentage opening of the recirculation valve 16 and the percentage opening of the diverter choke valve 24. For instance when the recirculation valve closes, the diverter choke valve opens, thus transferring production from the recirculation loop to the flow line. A diverter bypass loop, also referred to as a bypass loop, is provided so that the diverter choke valve 24 can be bypassed. A diverter bypass valve 26, also referred to herein as full bore valve 26, is provided in conduit 23 so that when diverter bypass valve 26 is fully open, the least amount of flow resistance will be encountered by the subsea pump downstream flow.

In one embodiment, prior to the start up of the pump 6, the diverter choke valve 24 is opened from 5 to 10%, creating resistance to flow and forcing flow through the recirculation loop. At this point the diverter bypass valve 26 is fully closed. The pressure drop across the choke valve 24 can be from 50 to 100 psi upon starting the pump 6. After startup of the pump 6, the full bore valve 26 is opened over a period of time, also referred to as the startup period of time, and the choke valve 24 is closed. When the full bore valve 26 is opened, there is almost no resistance to flow in the bypass loop. The startup period of time can vary depending on conditions.

In one embodiment, valves in the fluid handling system 100 are opened and closed utilizing existing controls that may already be present in a reservoir completion. In one embodiment, such controls are hydraulic open and close control lines. The pressure differentials between the open and close control lines attached to a specific valve will actuate the opening and closing of the valve. Thus pressurizing a hydraulic open or close control line will open or close the valve to which it is attached. In one embodiment, the open control line of the recirculation valve 16 can be combined with the close control line of the diverter choke valve 24, and the close control line of the recirculation valve 16 can be combined with the open control line of the diverter choke valve 24. This enables the coordinated opening of the diverter choke valve 24 with the closing of the recirculation valve 16, and the coordinated closing of the diverter choke valve 24 with the opening of the recirculation valve 16. By "coordinated" is meant that the actions are either simultaneous or are separated by a short lag time. In an alternative embodiment, such controls are electrical control lines. Alternatively, electrically actuated valves can be used for optimal controllability.

In one embodiment, a method for starting a subsea pump 6 in a pump station 4 along a flow line 1 in which fluid is flowing over a startup period of time while avoiding large pressure drops includes providing a choke valve 24 capable of being partially closed downstream of the subsea pump 6. The choke valve 24 is partially closed so that the choke valve has a choke valve percentage opening to restrict fluid flow through the choke valve. The subsea pump 6 is started up so that fluid flows through the subsea pump at a subsea pump flow rate and fluid flows through the choke valve 24 downstream of the subsea pump 6 at a choke valve flow rate less than the subsea pump flow rate.

Fluid in the flow line 9 downstream of the subsea pump 6 is directed through a recirculation loop, wherein the recirculation loop comprises a recirculation pipeline 7 and the recirculation loop intersects the flow line 9 at a first location downstream of the subsea pump 6 and upstream of the choke valve 24 and a second location upstream of the subsea pump 6 and the recirculation loop further comprises a recirculation valve 16 having a recirculation valve percentage opening along the recirculation loop. Over the startup period of time, the choke valve percentage opening is increased while the recirculation valve percentage opening is decreased. The diverter bypass valve 26 is finally opened, such that fluid is directed to flow through the bypass loop.

Through the use of the system disclosed herein, undesirable subsea pump pressure transients can be mitigated so that they do not cause significant pressure change at the reservoir or reservoir completion as the subsea pump 6 smoothly picks up the fluids production and the full bore valve 26 is fully opened.

The systems and methods of the present disclosure are useful for all types of liquid producing reservoirs, including those which are near depletion.

It should be noted that only the components relevant to the disclosure are shown in the figures, and that many other components normally part of a fluid handling system are not shown for simplicity.

Figure 3:
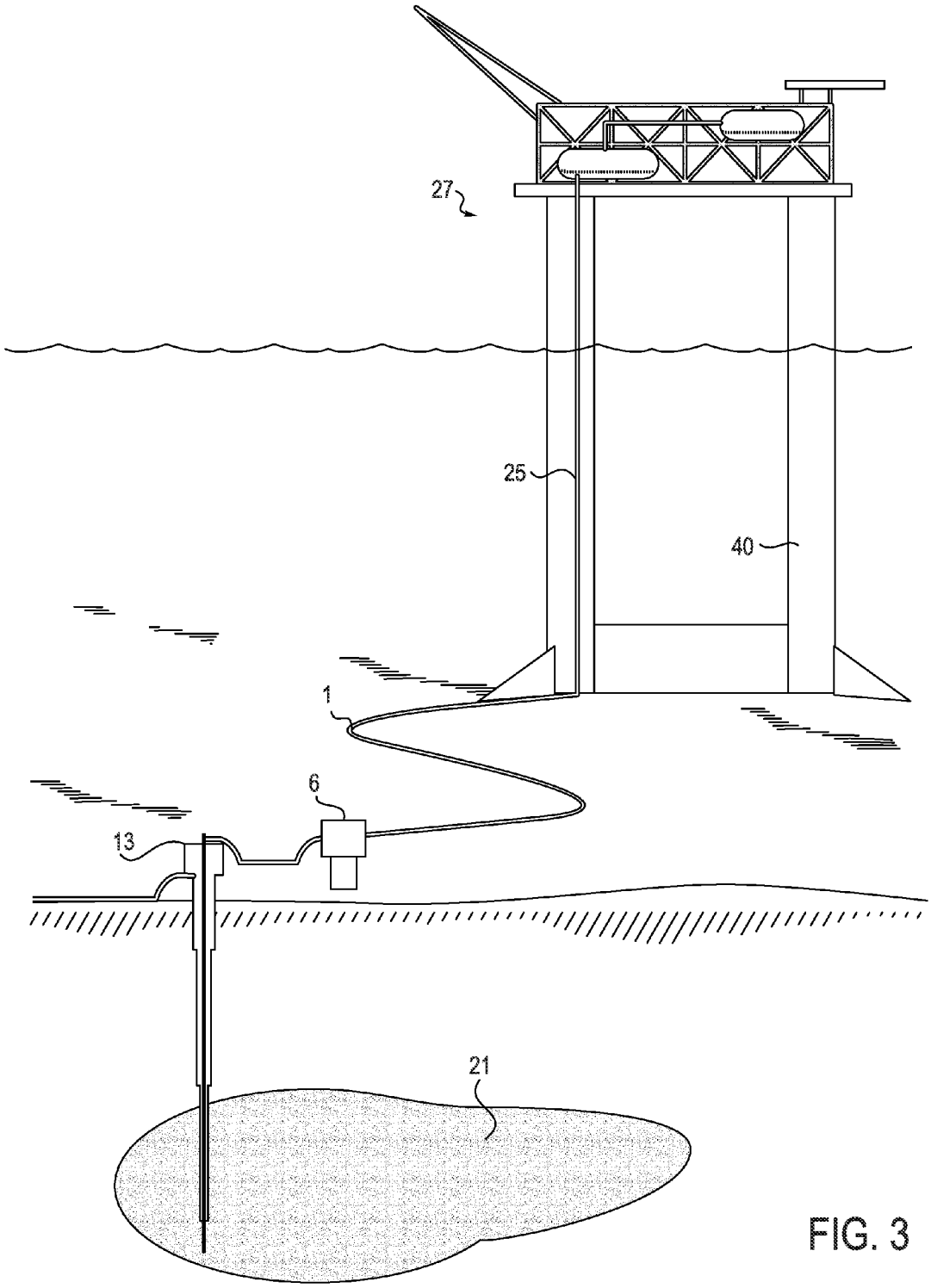
FIG. 3 is a simplified diagram illustrating an offshore fluid handling system according to one exemplary embodiment.

In one embodiment, the systems and methods of the present disclosure can be used in an offshore production facility as illustrated in FIG. 3. Fluids are produced from a subterranean reservoir 21 by a drill center 13. Subsea pump 6 is located along flow line 1 and pumps fluids into marine riser 25 to a surface facility 27 supported by legs 40. The choke valve can be choked significantly prior to the start of the subsea pump 6. Thus the produced fluids are diverted to the recirculation loop. The choke valve is opened gradually to ensure a smooth transition in terms of pressure transients. The pump speed and thus the production rate can then be increased over this transition.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

From the above description, those skilled in the art will perceive improvements, changes and modifications, which are intended to be covered by the appended claims.

What is claimed is:

1. A method for starting a subsea pump along an oil and gas flow line over a startup period of time while avoiding large pressure drops, comprising, in sequence:

a. providing a subsea pump along a flow line in which fluid is flowing and a choke valve capable of being partially closed downstream of the subsea pump;

b. partially closing the choke valve so that the choke valve has a choke valve percentage opening to restrict fluid flow through the choke valve;

c. starting the subsea pump so that fluid flows through the subsea pump at a subsea pump flow rate and fluid flows through the choke valve downstream of the subsea pump at a choke valve flow rate less than the subsea pump flow rate;

d. allowing fluid flowing in the flow line downstream of the subsea pump to be directed through a recirculation loop, wherein the recirculation loop comprises a recirculation pipeline and the recirculation loop intersects the flow line at a first location downstream of the subsea pump and upstream of the choke valve and a second location upstream of the subsea pump and the recirculation loop further comprises a recirculation valve having a recirculation valve percentage opening along the recirculation loop;

e. over the startup period of time, increasing the choke valve percentage opening while decreasing the recirculation valve percentage opening; and f. opening a full bore valve in a bypass loop comprising a bypass pipeline, wherein the bypass loop intersects the flow line at a location upstream or coincident with the first location at which the recirculation loop intersects the flow line and a second location downstream of the choke valve, such that fluid is directed to flow through the bypass loop.

2. The method of claim 1, wherein in step (b), the choke valve percentage opening is less than 50%.

3. The method of claim 1, wherein in step (d), the recirculation valve percentage opening is greater than 50%.

4. The method of claim 1, wherein in step (e), the choke valve percentage opening is increased to at least 75%; and the recirculation valve percentage opening is decreased to no more than 25%.

5. The method of claim 1, wherein in step (e), the choke valve percentage opening is increased to 100%; and the recirculation valve percentage opening is decreased to 0%.

* * * * *

UNITED STATES PATENT AND TRADEMARK OFFICE

CERTIFICATE OF CORRECTION

PATENT NO. : 9,133,690 B1
APPLICATION NO. : 14/480849
DATED : September 15, 2015
INVENTOR(S) : Tanju et al.

It is certified that error appears in the above-identified patent and that said Letters Patent is hereby corrected as shown below:

Title Page, item (71) and (72) should read

Baha Tulu Tanju, Houston, TX

Signed and Sealed this
Twentieth Day of October, 2015

Michelle K. Lee

Michelle K. Lee
*Director of the United States Patent and Trademark Office*